US009179819B2

(12) United States Patent
Ryu et al.

(10) Patent No.: US 9,179,819 B2
(45) Date of Patent: Nov. 10, 2015

(54) VESSEL HOLDER AND DISH WASHING MACHINE HAVING THE SAME

(75) Inventors: Jung Chan Ryu, Suwon-si (KR); Jae Young Choi, Suwon-si (KR); Sung Jin Kim, Suwon-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 1702 days.

(21) Appl. No.: 11/806,057

(22) Filed: May 29, 2007

(65) Prior Publication Data

US 2008/0149149 A1 Jun. 26, 2008

(30) Foreign Application Priority Data

Dec. 22, 2006 (KR) ..... 10-2006-0132875

(51) Int. Cl.
*A47L 15/50* (2006.01)
*A47L 15/00* (2006.01)

(52) U.S. Cl.
CPC ..... *A47L 15/505* (2013.01); *A47L 15/0065* (2013.01)

(58) Field of Classification Search
CPC ..... A47L 15/0065; A47L 15/505
USPC ..... 134/135; 211/41.8–41.9
See application file for complete search history.

(56) References Cited

U.S. PATENT DOCUMENTS 2,523,785 A * 9/1950 Sereno ..... 403/188
3,167,183 A * 1/1965 Claywell et al. ..... 211/41.2
3,289,854 A * 12/1966 Kauffman ..... 211/41.9
4,046,261 A * 9/1977 Yake ..... 211/41.8
4,589,556 A * 5/1986 Peretz ..... 211/41.9
4,917,248 A * 4/1990 Friskney ..... 211/41.8
4,927,033 A * 5/1990 Patera et al. ..... 211/41.9
5,405,018 A * 4/1995 Anthrop, Jr. ..... 211/41.9
5,794,792 A * 8/1998 Convertino ..... 211/12
5,918,749 A * 7/1999 Pille et al. ..... 211/41.9
6,123,204 A * 9/2000 Nelson et al. ..... 211/41.9
6,364,131 B1 * 4/2002 Moylan ..... 211/41.9
6,394,285 B1 * 5/2002 Arthurs et al. ..... 211/41.9
6,983,754 B1 * 1/2006 Anderson et al. ..... 134/22.1

(Continued)

FOREIGN PATENT DOCUMENTS

DE 199 44 883 * 3/2001
DE 20 2005 000 915 4/2005
DE 10 2004 019 344 9/2005
EP 1 683 465 7/2006
FR 2 776 499 * 10/1999
KR 20-1998-0020973 7/1998

OTHER PUBLICATIONS

European Patent Office 1 683 465 May 2005.*

(Continued)

*Primary Examiner* — Michael Barr
*Assistant Examiner* — Kevin G Lee
(74) *Attorney, Agent, or Firm* — Staas & Halsey LLP

(57) ABSTRACT

A vessel holder and a dish washing machine having the same, in which, when vessels are put into and washed in the dish washing machine, the vessels can be stably washed by improving a fixed state of each thereof. The dish washing machine includes a washing space, a vessel basket installed in the washing space, and includes wires, at least one vessel holder detachably installed to the vessel basket, and allowing a vessel to be inserted thereinto and supported therein. The vessel holder includes a plurality of supports elastically supporting the vessel, and an inserting part provided between the supports and allowing the vessel to be inserted thereinto.

15 Claims, 7 Drawing Sheets

(56) References Cited

U.S. PATENT DOCUMENTS

| | | | | |
|---|---|---|---|---|
| 7,543,712 | B2 * | 6/2009 | Purushothaman | 211/41.9 |
| 7,556,231 | B2 * | 7/2009 | Herbst et al. | 248/316.1 |
| 2004/0108283 | A1 * | 6/2004 | Miilu et al. | 211/41.9 |
| 2006/0138064 | A1 * | 6/2006 | Crudgington, Jr. | 211/41.9 |
| 2007/0277857 | A1 * | 12/2007 | Schessl et al. | 134/44 |

OTHER PUBLICATIONS

Machine translation of DE19944883A1, dated Mar. 2001.*
European Search Report issued May 9, 2008 in corresponding European Patent Application No. 07109270.4-2314.
Chinese Office Action for corresponding Chinese Application 200710110013.4; issued Jun. 19, 2009.

* cited by examiner

VESSEL HOLDER AND DISH WASHING MACHINE HAVING THE SAME

CROSS-REFERENCE TO RELATED APPLICATIONS

This application claims the benefit of Korean Patent Application No. 10-2006-0132875, filed on Dec. 22, 2006, in the Korean Intellectual Property Office, the disclosure of which is incorporated herein by reference.

BACKGROUND OF THE INVENTION

1. Field of the Invention

The present invention relates to a vessel holder and a dish washing machine having the same. More particularly, to a vessel holder and a dish washing machine having the same, in which, when vessels (i.e., cups, dishes, etc.) are disposed and washed in the dish washing machine, the vessel are more stably washed by improving a supported state of each vessel.

2. Description of the Related Art

As disclosed in Korean Utility Model Registration No. 20-0136461, a conventional dish washing machine includes a main body having a washing space, a vessel basket provided to be slidable in the main body and having a plurality of wires intersecting with each other, injection nozzle assemblies provided at upper and lower portions of the vessel basket and spraying washing water, and a sump connected with the injection nozzle assemblies by means of guide pipes and pumping the washing water toward the injection nozzle assemblies.

Various vessels, for example, cups including utensils such as dishes and platter are put and washed in the vessel basket. The vessel basket is adapted to fix the dishes and bowls, but not the cups. Hence, when high-pressure washing water is sprayed toward the cups, the cups move around to collide with its surrounding vessels.

Further, an attempt is made to provide a structure for independently fixing the cups themselves, but there is a limitation to the fabrication of such a fixing structure because the diversity of the cups.

SUMMARY OF THE INVENTION

Accordingly, it is an aspect of the present invention to provide a vessel holder and a dish washing machine having the same, in which, when a variety of vessels, particularly cups, are put into and washed in the dish washing machine, the vessels such as cups can be stably washed by providing a structure of fixing the cups.

Additional aspects and/or advantages of the invention will be set forth in part in the description which follows and, in part, will be apparent from the description, or may be learned by practice of the invention.

The foregoing and/or other aspects of the present invention are achieved by providing a dish washing machine, which includes a washing space, a vessel basket installed in the washing space, and including wires, at least one vessel holder detachably installed to the vessel basket, and allowing a vessel to be inserted thereinto and supported therein. According to an aspect of the present invention, the vessel holder includes a plurality of supports elastically supporting the vessel, and an inserting part provided between the supports and allowing the vessel to be inserted thereinto.

According to an aspect of the present invention, the vessel basket includes first wires and second wires intersecting with the first wires, and the vessel holder is installed at an intersection of each first wire and each second wire.

According to an aspect of the present invention, the vessel holder further includes a coupler, which is provided under the supports and the inserting part, and is coupled with the vessel basket.

According to an aspect of the present invention, the supports includes a first support extending upwards from the coupler and a second support disposed adjacent to the first support, and each of the first and second supports includes a bent part at an end thereof such that the vessel is easily inserted.

Further, according to an aspect of the present invention, the coupler includes a first seat seated on each first wire, and second seats seated on each second wire, and the first and second seats intersect with each other so as to correspond to an arrangement in which the first and second wires intersect with each other.

According to an aspect of the present invention, the first wires are disposed on the second wires, the first seat includes an upper surface higher than that of each of the second seats so as to correspond to the arrangement of the first and second wires. The vessel holder is inclinedly installed by rotating about each of the second wires and the second seats in a state in which the first and second seats are seated on the first and second wires such that the vessel can be smoothly washed according to a shape of the vessel inserted into the vessel holder.

According to an aspect of the present invention, the first seat is provided so as to have a lower portion thereof opened and to accommodate each of the first wires, and the second seats are provided on opposite sides of the first seat so as to accommodate each of the second wires. Each of the second seats includes a vertical inner height greater than a diameter of each of the second wires such that the vessel holder can be rotated.

According to an aspect of the present invention, each of the second seats includes a claw that surrounds each of the second wires and prevents escape from each of the second wires.

It is another aspect of the present invention to provide a vessel holder which includes a coupler coupled with a basket including wires, a plurality of supports extending from the coupler and elastically fixing a vessel in the basket, and an inserting part provided between the supports and inserted by the vessel.

According to an aspect of the present invention, the wires include first wires and second wires intersecting with the first wires. The coupler includes a first seat on which each of the first wire is seated and second seats on which each of the second wire is seated, and be coupled with an intersection of each of the first wires and each of the second wires.

According to an aspect of the present invention, each of the first wires is in contact with each of the second wires and be located on each of the second wires. The first seat includes an upper surface higher than that of each of the second seats so as to correspond to an arrangement of the first and second wires.

According to an aspect of the present invention, the first seat is provided so as to have a lower portion thereof opened and to accommodate each of the first wires, and the second seats are provided on opposite sides of the first seat so as to accommodate each of the second wires. Each of the second seats includes a claw that surrounds each of the second wires and prevents the coupler from escaping from each of the second wires.

According to an aspect of the present invention, each of the second seats includes a vertical inner height greater than a diameter of each of the second wires such that the vessel holder is inclinedly installed by rotating about each of the second wires according to a shape of the vessel inserted into the vessel holder.

According to an aspect of the present invention, the supports includes the first support extending upwards from the coupler and the second support disposed adjacent to the first support, and the vessel is inserted between the first and second supports and be fixedly supported by elastically supporting action of the first and second supports.

According to an aspect of the present invention, each of the first and second supports includes a smoothly bent part at an end thereof so as to prevent a mouth of the vessel from colliding with the ends of the first and second supports when the vessel is inserted.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE PREFERRED EMBODIMENTS

Figure 1:
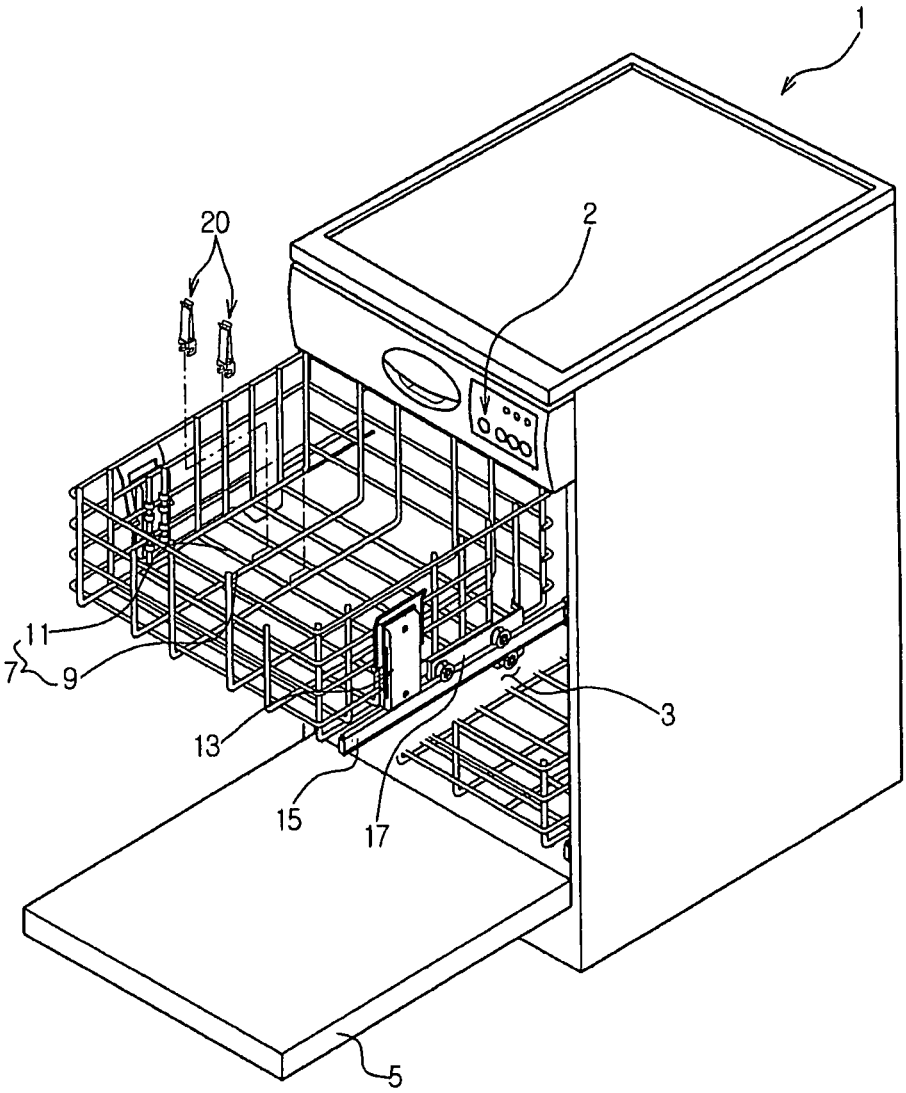
FIG. 1 is a perspective view illustrating a dish washing machine according to an embodiment of the present invention.

Reference will now be made in detail to the embodiments of the present invention, examples of which are illustrated in the accompanying drawings, wherein like reference numerals refer to the like elements throughout. The embodiments are described below to explain the present invention by referring to the figures.

As illustrated in FIG. 1, a dish washing machine comprises a main body 1, a control panel 2 provided at a front upper portion of the main body 1, a washing space 3 formed in the main body 1, and a door 5 hinged to a lower portion of the main body 1, in order to open and close the washing space 3.

The washing space 3 comprises a vessel basket 7, which accommodates vessels such as dishes to be washed. The vessel basket 7 comprises handles 13 on opposite sides thereof, providing easy installation and grasping of the vessel basket 7, and roller sets 17 sliding the vessel basket 7. The washing space 3 further comprises rail sets 15 on inner sides thereof, which guide sliding movement of the roller sets 17.

As shown in FIG. 1, for example, the vessel basket 7 comprises crisscrossed wires. For convenience, the wires 9 arranged along a width direction of the dish washing machine are referred to as "first wires," and the wires 11 arranged perpendicular to the first wires 9 are referred to as "second wires."

In the vessel basket 7, the first and second wires 9 and 11 intersect to form intersections. Vessel holders 20 having the shape of a clip are installed to the intersections. Each vessel holder 20 allows a utensil such as a cup, which is difficult to fix to the vessel basket 7, to be inserted thereinto and supported therein. Hereinafter, an example in which the cup is inserted into the vessel holder 20 will be described. However, the present invention is not limited any particular type of vessel and may vary as necessary.

Figures 2A, 2B:
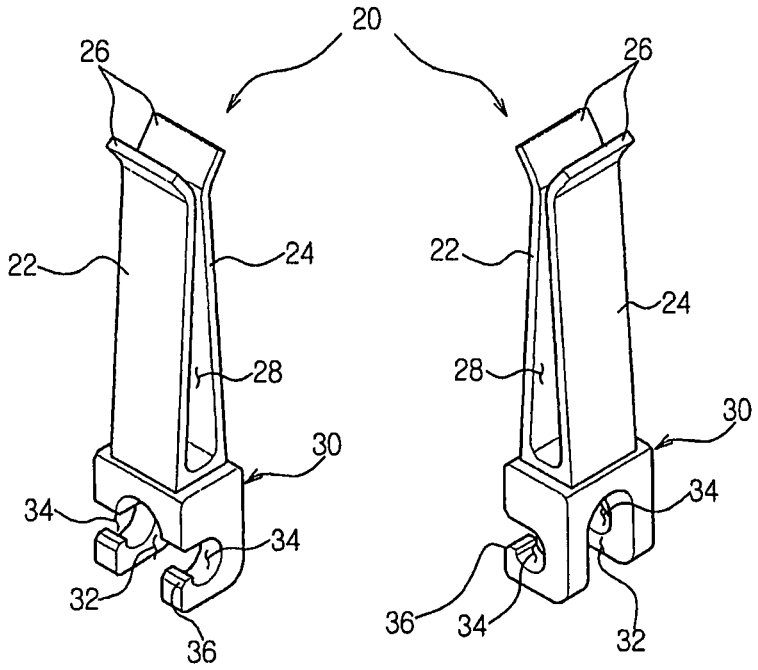
FIGS. 2A and 2B are front and rear perspective views of a vessel holder according to an embodiment of the present invention.

As illustrated in FIGS. 2A and 2B, each vessel holder 20 comprises a coupler 30 coupled to the intersection of the first and second wires 9 and 11 (see FIG. 1), and supports 22 and 24 extending upwards from the coupler 30.

One of the supports 22 and 24 is referred to as first support 22, and the other is referred to as second support 24. Each of the first and second supports 22 and 24 is provided, at an upper end thereof, with a bent part 26, which is smoothly bent. An inserting part 28 is defined by the first and second supports 22 and 24 such that the first and second supports 22 and 24 are separated from each other at upper portions thereof, and thus allow the cup to be inserted therebetween. The inserting part 28 comprises a triangular shape in such a manner that an interval between the first and second supports 22 and 24 is reduced in proportion to a distance from the coupler 30. An interval between the bent parts 26 is increased in inverse proportion to a distance from the coupler 30.

The bent parts 26 are provided to guide smooth insertion of the cup. The reason the inserting part 28 has the triangular shape is so aimed that the cup is caught between the first and second supports 22 and 24, and simultaneously inner and outer circumferences of the cup are contacted and supported at a portion where the interval between the first and second supports 22 and 24 is smallest.

The coupler 30 under the first and second supports 22 and 24 comprises a first tunnel-like seat 32 into and on which the first wire 9 (see FIG. 1) is inserted and seated, and second seats 34 into and on which the second wire 11 (see FIG. 1) is inserted and seated and that intersect with the first seat 32. Each of the second seats 34 is provided, at an end thereof, with a claws 36 on which the second wire 11 is caught.

Here, the second seats 34 are located on left and right sides of the first seat 32. That is, the second seats 34 are positioned at opposite sides of the first seat 32. Thus, the first seat 32 allows the vessel holder 20 to be seated on the first wire 9 (see FIG. 1) in a vertical direction. In this state, the second seats 34 allow the vessel holder 20 to be guided toward and seated on the second wire 11 (see FIG. 1) in a horizontal direction.

Figure 3:
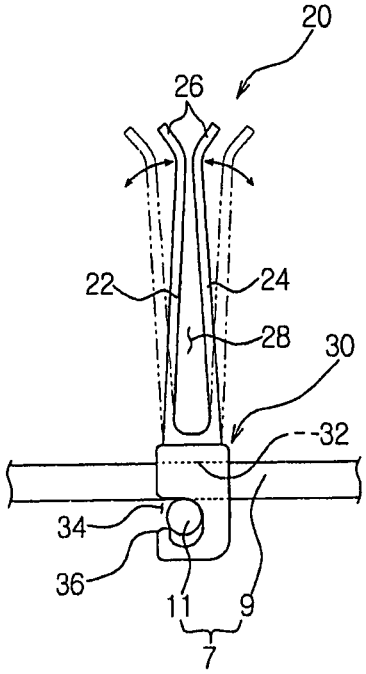
FIG. 3 is a side view illustrating a vessel holder according to an embodiment of the present invention.

As illustrated in FIG. 3, the vessel holder 20 is adapted to be elastically deformed to some extent in backward and forward directions when an external force is applied to the first and second supports 22 and 24. Thus, when the external force is released from the first and second supports 22 and 24, the first and second supports 22 and 24 are restored to their original positions.

According to an embodiment of the present invention, the vessel holder 20 is formed of resin material having high elasticity. The high elasticity of the vessel holder 20 allows any kind of cup to be inserted into and supported on the vessel holder 20. Further, since the inserting part 28 has a triangular space that gradually increases from top to bottom, a mouth of the cup can be prevented from being damaged although the mouth of the cup swings to some extent after the cup is inserted into the inserting part 28.

In the coupler 30 which constitutes the lower portion of the vessel holder 20, the first seat 32 comprises an upper surface higher than those of the second seats 34, this corresponds to the arrangement of the first and second wires 9 and 11 because the first wire 9 is located on the second wire 11.

According to an embodiment of the present invention, a vertical inner height of each of the second seats 34 is greater than a diameter of the second wire 11. This is for allowing the vessel holder 20 to be rotated about the second wire 11 by a predetermined angle in backward and forward directions. This rotation and its necessity will be described in detail below.

The present invention is not limited to the arrangement of these wires as described above, and may vary as necessary. For example, the first and second seats 32 and 34 can be changed in position in a vertical direction.

Hereinafter, both the sequence of mounting each vessel holder 20 according to the present invention and the state in which the cup is supported by each vessel holder 20 will be described.

Figure 4:
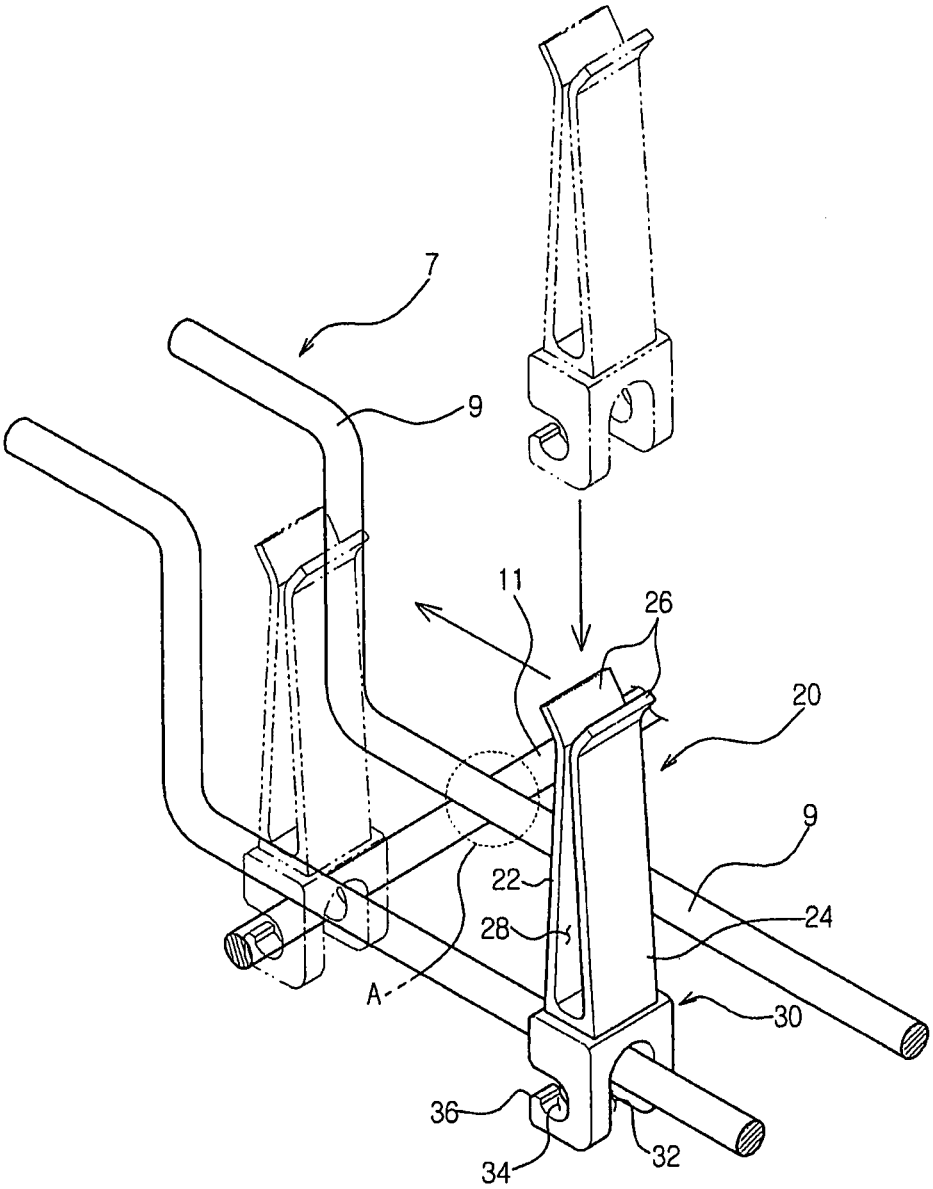
FIG. 4 is a perspective view illustrating a method of mounting a vessel holder according to an embodiment of the present invention.

As illustrated in FIG. 4, the vessel holder 20 is located above the vessel basket 7 at a predetermined distance. In this state, the vessel holder 20 moves toward the vessel basket 7 such that the first seat 32 of the vessel holder 20 is seated on the first wire 9 of the vessel basket 7.

Then, the vessel holder 20 is moved toward an intersection 'A' where the first wire 9 intersects with the second wire 11. In this case, the vessel holder 20 is guided by the first wire 9, and is moved toward the intersection 'A'.

When the vessel holder 20 arrives at the intersection 'A', the second wire 11 is inserted into the second seats 34 through front openings of the second seats 34. Thereby, the mounting of the vessel holder 20 is completed.

Figure 5:
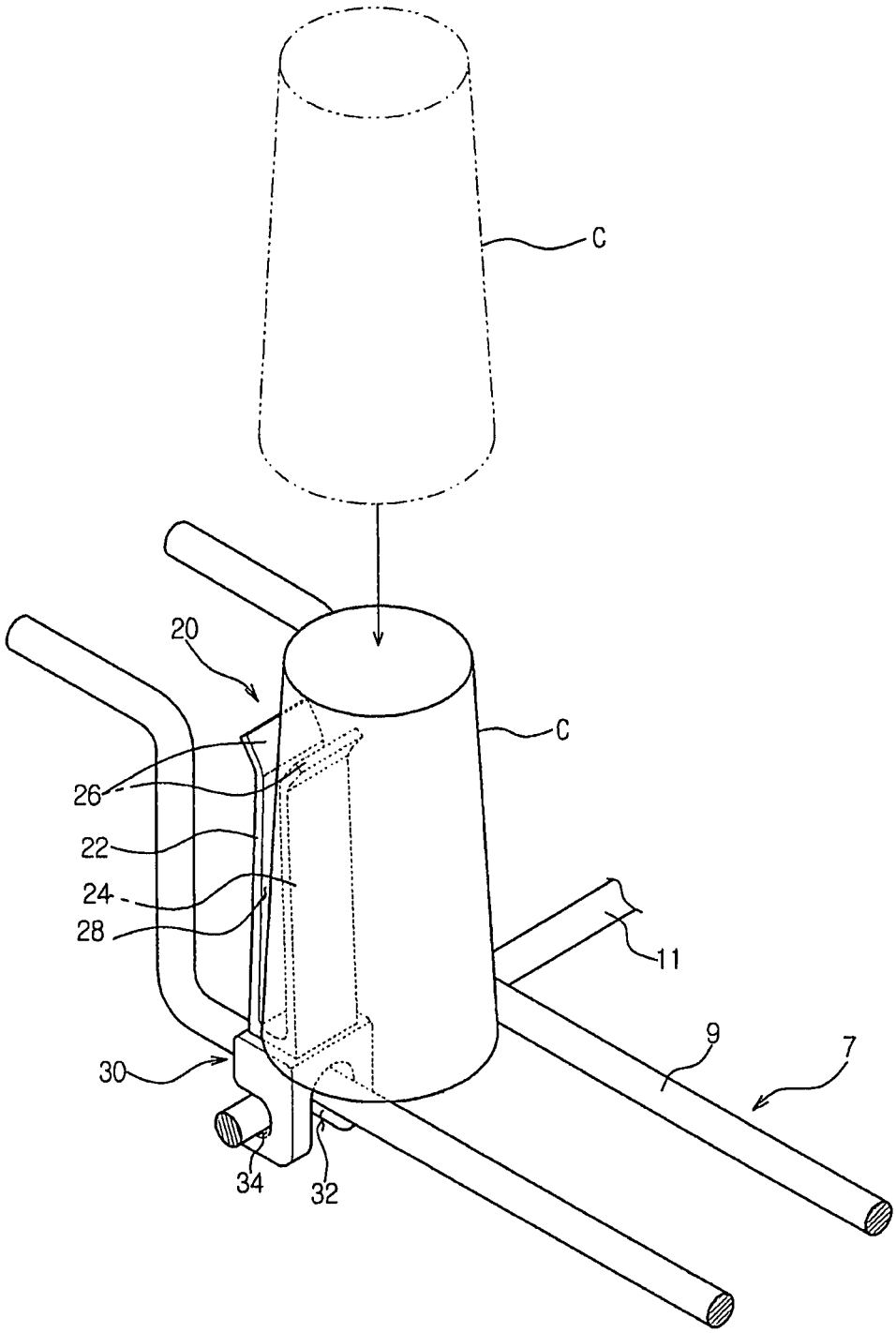
FIG. 5 is a perspective view illustrating a method of inserting a cup into a vessel holder according to an embodiment of the present invention.

As illustrated in FIG. 5, as for the method of inserting the cup C into the vessel holder 20, the cup 'C' is located above the vessel holder 20, and then is moved downwards such that the mouth of the cup 'C' is inserted between the first and second supports 22 and 24.

At this time, the first and second supports 22 and 24 are gradually spread outwards from each other. The inner and outer circumferences of the cup are elastically supported by the elasticity of the first and second supports 22 and 24 themselves.

Figure 6A:
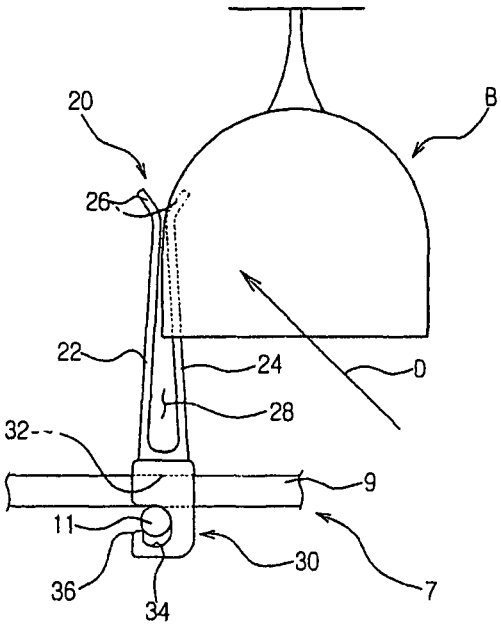
FIGS. 6A and 6B are side views illustrating how a cup and a vessel holder are installed according to a shape of the cup in accordance with an embodiment of the present invention.
Figure 6B:
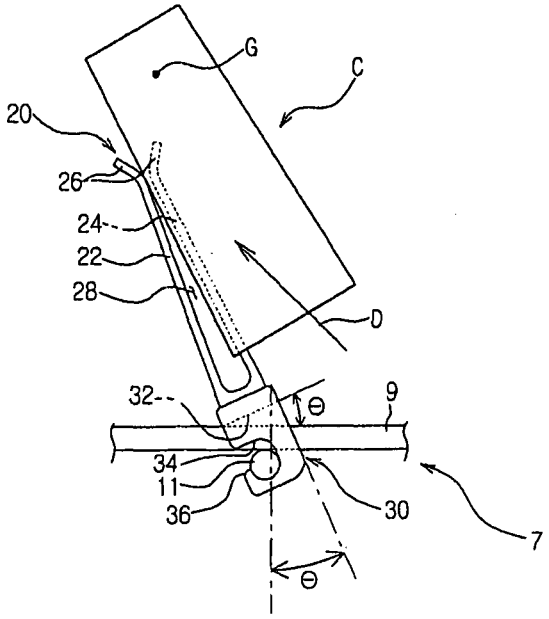

FIGS. 6A and 6B illustrate how the vessel holder 20 is mounted depending on the shape of a cup, wherein FIG. 6A is for the case in which a cup 'B', such as a wine glass, having a relatively great mouth is inserted into the vessel holder 20, and FIG. 6B is for the case in which a cup 'C' having a relatively small mouth is inserted into the vessel holder 20.

Washing water is sprayed in the washing space 3 by means of injection nozzle assemblies 40*a*, 40*b* and 40*c* (see FIG. 7) in an oblique direction rather than a linear direction. As illustrated in FIG. 6A, in the case of the cup 'B' having a relatively great mouth, when the washing water 'D' is sprayed in an oblique direction, the washing water 'D' has no difficulty in entering into and washing the cup 'B' although the cup 'B' is disposed in a vertical direction because the mouth of the cup 'B' is great. As such, the vessel holder 20 is installed to the vessel basket 7 in a vertical direction, for example.

At this time, the second wire 11 is in contact with the upper surfaces of the second seats 34, and is spaced apart from lower surfaces of the second seats 34 by a predetermined interval.

In contrast, as in FIG. 6B, in the case of the cup 'C' having a relatively small mouth, when the cup 'C' stands in a vertical direction, and when the washing water 'D' is sprayed in an oblique direction, the washing water 'D' has difficulty in entering into and washing the cup 'C'.

For this reason, it is necessary to lean the cup 'C' by a predetermined angle θ such that the washing water 'D' easily enters into the cup 'C'. When the cup 'C' and the vessel holder 20 are pushed in a certain direction after the cup 'C' is inserted into the vessel holder 20, they are inclined in the pushed direction by the predetermined angle θ.

The center of gravity of the cup 'C' is located near a bottom of the cup 'C', and the gravity acts in a direction in which the inclined state is maintained with no change at present. Hence, this inclined state is stably maintained.

At this time, a rear end of the first seat 32 is separated from the first wire 9. Thus, an inclined angle, which is formed by an upper surface of the first seat 32 and an outer surface of the first wire 9, corresponds to the currently inclined angle θ.

The second wire 11 is in contact with the lower surfaces of the second seats 34, and particularly is fitted between the claws 36 and rear inner walls of the second seats 34. Thus, the currently inclined state can be maintained with no change.

Now, the overall operation of the dish washing machine according to an embodiment of the present invention will be described.

Figure 7:
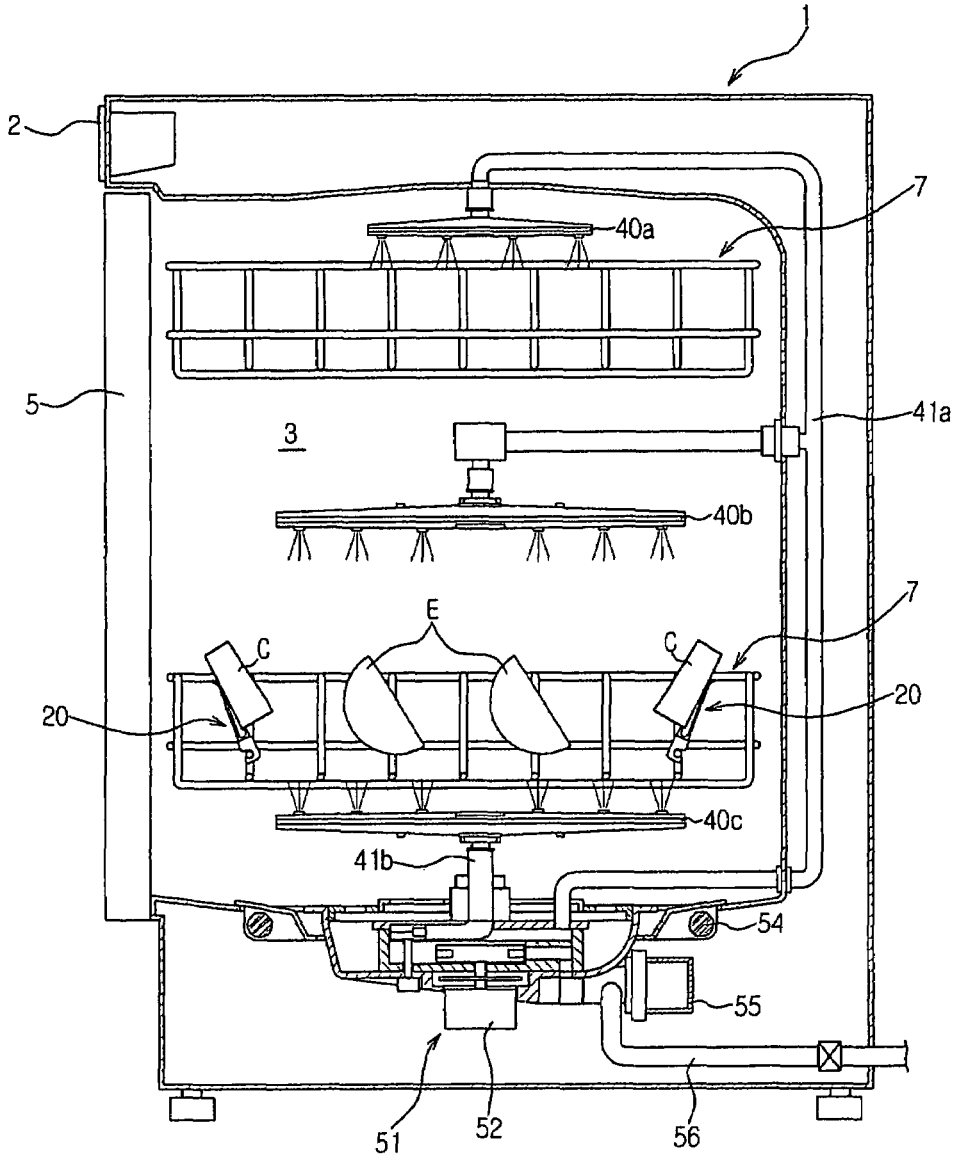
FIG. 7 illustrates an operation of a dish washing machine according to an embodiment of the present invention.

As illustrated in FIG. 7, a user seats vessels such as bowls 'E' and cups 'C' on the vessel basket 7 having the vessel holders 20, and then the vessel basket 7 is pushed into the washing space 3. Then, the door 5 is closed, and the dish washing machine is operated. Thereby, the washing water is introduced into the washing space 3.

The introduced washing water is heated by a heater 54 installed under the washing space 3. The heated washing water is introduced into a sump 51 again, and then is pumped upwards by means of a pump 52 mounted to the sump 51.

The pumped washing water is guided to the injection nozzle assemblies 40*a*, 40*b* and 40*c* through guide pipes 41*a* and 41*b*, and is sprayed into the washing space 3. The sprayed washing water collides with and washes the bowls 'E' and the cups 'C'.

At this time, each cup 'C' is disposed in an inclined or vertical state according its shape such that the washing water sprayed therebelow is smoothly introduced. Thereby, the washing of the cups 'C' can be performed in a more reliable manner.

According to an embodiment of the present invention, a separate structure capable of fixing the vessels, particularly the cups is provided, so that the vessels can be more stably disposed during washing, and thus be prevented from being damaged.

Further, according to an embodiment of the present invention, each vessel can be disposed in an inclined or vertical posture according to its shape, so that the washing water can be more smoothly introduced into the vessels. Thus, the washing performance of the vessels can be improved.

Although few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A dish washing machine comprising:

a body having a washing space;

a vessel basket installed in the body, the vessel basket including first wires and second wires to intersect with the first wires; and at least one vessel holder detachably installed to the vessel basket, and to allow a vessel to be inserted thereinto and supported therein, the at least one vessel holder including first and second supports, an inserting part provided between the first and second supports to accommodate a portion of the vessel, and a coupler provided under the first and second supports and the inserting part to be coupled with the vessel basket, wherein the vessel holder is capable of being installed at an intersection between the first and second wires vertically and inclinedly with respect to at least one of the first wires and the second wires and rotating between a vertical installation and an inclined installation by use of the coupler, wherein the first and second supports support the vessel in a manner that when the first support is inserted into an inside of the vessel, the first support is disposed at an inner portion of the vessel and the second support is disposed at an outer portion of the vessel, and when the second support is inserted into an inside of the vessel, the second support is disposed at the inner portion of the vessel and the first support is disposed at the outer portion of the vessel, wherein the first support and the second support include a bent part at an upper portion thereof, and the bent part is bent such that the first and second support are separated from each other at upper portions thereof, and wherein the vessel holder has a symmetrical shape so that the first support and the second support correspond to each other.

2. The dish washing machine as claimed in claim 1, wherein the first and second supports extend upwards from the coupler.

3. The dish washing machine as claimed in claim 1, wherein:

the coupler includes a first seat seated on one of the first wires, and a second seat seated on one of the second wires which intersects with the one of the first wires.

4. The dish washing machine as claimed in claim 3, wherein the second seat includes a claw that surrounds one of the second wires and prevents the coupler from escaping from the one of the second wires.

5. A dish washing machine comprising:

a body having a washing space;

a vessel basket installed in the body, the vessel basket including first wires and second wires to intersect with the first wires; and at least one vessel holder detachably installed to the vessel basket, and to allow a vessel to be inserted thereinto and supported therein, the at least one vessel holder including first and second supports, an inserting part provided between the first and second supports to accommodate a portion of the vessel, and a coupler provided under the first and second supports and the inserting part to be coupled with the vessel basket, wherein the vessel holder is capable of being installed at an intersection between the first and second wires vertically and inclinedly with respect to the at least one of the first and second wires, wherein the first and second supports support the vessel in a manner that when the first support is inserted into an inside of the vessel, the first support is disposed at an inner portion of the vessel and the second support is disposed at an outer portion of the vessel, and when the second support is inserted into an inside of the vessel, the second support is disposed at the inner portion of the vessel and the first support is disposed at the outer portion of the vessel, wherein the first support and the second support include a bent part at an upper portion thereof, and the bent part is bent such that the first and second support are separated from each other at upper portions thereof, and wherein the vessel holder has a symmetrical shape so that the first support and the second support correspond to each other, wherein the first and second supports extend upwards from the coupler, and wherein the inserting part comprises a triangular shape in such a manner that an interval between the first and second supports is reduced in proportion to a distance from the coupler, and an interval between the bent parts is increased in inverse proportion to a distance from the coupler.

6. A dish washing machine comprising:

a body having a washing space;

a vessel basket installed in the body, the vessel basket including first wires and second wires to intersect with the first wires; and at least one vessel holder detachably installed to the vessel basket, and to allow a vessel to be inserted thereinto and supported therein, the at least one vessel holder including first and second supports, an inserting part provided between the first and second supports to accommodate a portion of the vessel, and a coupler provided under the first and second supports and the inserting part to be coupled with the vessel basket, wherein the vessel holder is capable of being installed at an intersection between the first and second wires vertically and inclinedly with respect to the at least one of the first and second wires, wherein the first and second supports support the vessel in a manner that when the first support is inserted into an inside of the vessel, the first support is disposed at an inner portion of the vessel and the second support is disposed at an outer portion of the vessel, and when the second support is inserted into an inside of the vessel, the second support is disposed at the inner portion of the vessel and the first support is disposed at the outer portion of the vessel, wherein the first support and the second support include a bent part at an upper portion thereof, and the bent part is bent such that the first and second support are separated from each other at upper portions thereof, and wherein the vessel holder has a symmetrical shape so that the first support and the second support correspond to each other, wherein the coupler includes a first seat seated on one of the first wires, and a second seat seated on one of the second wires which intersects with the one of the first wires, and wherein:

the first wires are disposed on the second wires;

the first seat includes an upper surface higher than that of the second seat so as to correspond to the arrangement of the first and second wires; and the vessel holder is inclinedly installed by rotating about the second wires and the second seat in a state in which the first and second seats are seated on the first and second wires such that the vessel is smoothly washed according to a shape of the vessel inserted into the vessel holder.

7. The dish washing machine as claimed in claim 6, wherein:

the first seat has an opened lower portion thereof to accommodate one of the first wires;

the second seat is provided on opposite portion of the first seat so as to accommodate one of the second wires; and the second seat includes a vertical inner height greater than a diameter of the second wires such that the vessel holder is rotated.

8. The dish washing machine as claimed in claim 6, wherein the vessel in the vessel holder is stably inclined at a predetermined angle such that washing water enters into the vessel.

9. A vessel holder comprising:

a coupler coupled with a basket including wires;

first and second supports extended from the coupler and to be elastically deformed to allow the vessel to be inserted thereinto and removed therefrom; and an inserting part provided between the first and second supports to accommodate a portion of the vessel, wherein the wires include first wires and second wires to intersect with the first wires, and the coupler to be coupled with an intersection between one of the first wires and one of the second wires which intersects with the one of the first wires, wherein the vessel holder is capable of being installed at the intersection vertically and inclinedly with respect to at least one of the first wires and the second wires, and rotating between a vertical installation and an inclined installation by use of the coupler, wherein the first and second supports extended with respect to the first wires and the second wires when the coupler is coupled with the intersection and support the vessel in a manner that when the first support is inserted into an inside of the vessel, the first support is disposed at an inner portion of the vessel and second support is disposed at an outer portion of the vessel, and when the second support is inserted into an inside of the vessel, the second support is disposed at the inner portion of the vessel and the first support is disposed at the outer portion of the vessel, wherein the first support and the second support include a bent part at an upper portion thereof, and the bent part is bent such that the first and second support are separated from each other at upper portions thereof, and wherein the vessel holder has a symmetrical shape so that the first support and the second support correspond to each other.

10. The vessel holder as claimed in claim 9, wherein the coupler includes a first seat on which one of the first wires is seated and a second seat on which one of the second wires which intersects with the one of the first wires is seated.

11. The vessel holder as claimed in claim 10, wherein:

the one of the first wires is in contact with the one of the second wires and is located on the one of the second wires; and the first seat includes an upper surface higher than that of the second seat so as to correspond to arrangement of the first and second wires.

12. The vessel holder as claimed in claim 11, wherein:

the first seat has a lower portion thereof opened and to accommodate one of the first wires;

the second seat is provided on opposite portion of the first seat so as to accommodate one of the second wires; and the second seat includes a claw that surrounds one of the second wires and prevents the coupler from escaping from the second wires.

13. The vessel holder as claimed in claim 9, wherein the first and second supports include the bent part at an end portion thereof so as to prevent a mouth of the vessel from colliding with the end portion of the first and second supports when the vessel is inserted.

14. A vessel holder comprising:

a coupler coupled with a basket including wires;

first and second supports extended from the coupler and to be elastically deformed to allow the vessel to be inserted thereinto and removed therefrom; and an inserting part provided between the first and second supports to accommodate a portion of the vessel, wherein the wires include first wires and second wires to intersect with the first wires, and the coupler to be coupled with an intersection between one of the first wires and one of the second wires which intersects with the one of the first wires, wherein the coupler is capable of being installed at the intersection vertically and inclinedly with respect to the at least one of the first and second wires, wherein the first and second supports extended with respect to the first wires and the second wires when the coupler is coupled with the intersection and support the vessel in a manner that when the first support is inserted into an inside of the vessel, the first support is disposed at an inner portion of the vessel and second support is disposed at an outer portion of the vessel, and when the second support is inserted into an inside of the vessel, the second support is disposed at the inner portion of the vessel and the first support is disposed at the outer portion of the vessel, wherein first support and the second support include a bent part at an upper portion thereof, and the bent part is bent such that the first and second support are separated from each other at upper portions thereof, wherein the vessel holder has a symmetrical shape so that the first support and the second support correspond to each other, wherein the coupler includes a first seat on which one of the first wires is seated and a second seat on which one of the second wires which intersects with the one of the first wires is seated, and wherein the second seat includes a vertical inner height greater than a diameter of the second wires such that the vessel holder is inclinedly installed by rotating about the second wires according to a shape of the vessel inserted into the vessel holder.

15. A vessel holder comprising:

a coupler coupled with a basket including wires;

first and second supports extended from the coupler and to be elastically deformed to allow the vessel to be inserted thereinto and removed therefrom; and an inserting part provided between the first and second supports to accommodate a portion of the vessel, wherein the wires include first wires and second wires to intersect with the first wires, and the coupler to be coupled with an intersection between one of the first wires and one of the second wires which intersects with the one of the first wires, wherein the coupler is capable of being installed at the intersection vertically and inclinedly with respect to the at least one of the first and second wires, wherein the first and second supports extended with respect to the first wires and the second wires when the coupler is coupled with the intersection and support the vessel in a manner that when the first support is inserted into an inside of the vessel, the first support is disposed at an inner portion of the vessel and second support is disposed at an outer portion of the vessel, and when the second support is inserted into an inside of the vessel, the second support is disposed at the inner portion of the vessel and the first support is disposed at the outer portion of the vessel, wherein first support and the second support include a bent part at an upper portion thereof, and the bent part is bent such that the first and second support are separated from each other at upper portions thereof, wherein the vessel holder has a symmetrical shape so that the first support and the second support correspond to each other, wherein the first and second supports include the bent part at an end portion thereof so as to prevent a mouth of the vessel from colliding with the end portion of the first and second supports when the vessel is inserted, and wherein the inserting part comprises a triangular shape in such a manner that an interval between the first and second supports is reduced in proportion to a distance from the coupler, and an interval between the bent parts is increased in inverse proportion to a distance from the coupler.

* * * * *